US007896688B2

(12) United States Patent
Sukegawa et al.

(10) Patent No.: US 7,896,688 B2
(45) Date of Patent: Mar. 1, 2011

(54) ELECTRICAL CONNECTOR WITH FLEXIBLE CIRCUIT BOARD

(75) Inventors: Akihito Sukegawa, Tokyo (JP); Hiroshi Nakayama, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 12/092,135

(22) PCT Filed: Aug. 31, 2006

(86) PCT No.: PCT/JP2006/317269

§ 371 (c)(1),
(2), (4) Date: Jul. 29, 2009

(87) PCT Pub. No.: WO2007/052405

PCT Pub. Date: May 10, 2007

(65) Prior Publication Data

US 2009/0305566 A1 Dec. 10, 2009

(30) Foreign Application Priority Data

Oct. 31, 2005 (JP) ..... P2005-316231

(51) Int. Cl.
*H01R 12/00* (2006.01)

(52) U.S. Cl. ..... 439/494

(58) Field of Classification Search ..... 439/83, 439/79, 80, 492, 494, 499, 77
See application file for complete search history.

(56) References Cited

U.S. PATENT DOCUMENTS 3,149,896 A * 9/1964 Hall ..... 439/329
3,214,713 A * 10/1965 Strobel ..... 439/418
3,702,982 A * 11/1972 Kelly et al. ..... 439/418
3,731,254 A * 5/1973 Key ..... 439/494
3,938,378 A * 2/1976 Fineman et al. ..... 73/114.23
4,181,395 A * 1/1980 Grabowski ..... 439/499
4,621,305 A * 11/1986 Daum ..... 361/749
4,647,133 A * 3/1987 Renken et al. ..... 439/426
4,695,106 A * 9/1987 Feldman et al. ..... 439/83
4,756,940 A * 7/1988 Payne et al. ..... 428/78
4,938,379 A * 7/1990 Kellner ..... 220/370
4,948,378 A * 8/1990 Hoshino ..... 439/271
5,201,663 A * 4/1993 Kikuchi et al. ..... 439/83

(Continued)

FOREIGN PATENT DOCUMENTS

JP 03-004463 1/1991

(Continued)

OTHER PUBLICATIONS

Japanese Office Action dated May 25, 2010 with English translation.

*Primary Examiner*—Neil Abrams
(74) *Attorney, Agent, or Firm*—Whitham Curtis Christofferson & Cook, PC

(57) ABSTRACT

A contact pin is accommodated in the housing body such that a first end portion of which is adapted to be subjected to soldering and is projected from an outer face of the housing body. A cover body including upper cover (17) and lower cover (18) is coupled to the housing body so as to cover the first end portion of the contact pin.

3 Claims, 6 Drawing Sheets

U.S. PATENT DOCUMENTS

| | | | | |
|---|---|---|---|---|
| 5,201,664 | A * | 4/1993 | Korsunsky et al. | 439/83 |
| 5,242,311 | A * | 9/1993 | Seong | 439/135 |
| 5,252,091 | A * | 10/1993 | Fujita et al. | 439/499 |
| 5,356,308 | A * | 10/1994 | Toba et al. | 439/495 |
| 5,501,612 | A * | 3/1996 | Green | 439/499 |
| 6,287,151 | B1 * | 9/2001 | Matsuzaki et al. | 439/630 |
| 6,394,816 | B1 * | 5/2002 | Watanabe | 439/67 |
| 6,402,532 | B1 * | 6/2002 | Ko | 439/108 |
| 6,830,478 | B1 * | 12/2004 | Ko | 439/579 |
| 7,273,390 | B2 * | 9/2007 | Iida et al. | 439/494 |
| 7,318,730 | B2 * | 1/2008 | Miyazaki | 439/83 |
| 7,381,064 | B2 * | 6/2008 | Bolen et al. | 439/67 |
| 2009/0227138 | A1 * | 9/2009 | Lv et al. | 439/466 |

FOREIGN PATENT DOCUMENTS

| | | | |
|---|---|---|---|
| JP | 2003-4463 | * | 1/1991 |
| JP | 6-314581 | | 11/1994 |
| JP | 09-055243 | | 2/1997 |
| JP | 10-340753 | | 12/1998 |
| JP | 11-26102 | | 1/1999 |
| JP | 2002-025667 | | 1/2002 |
| JP | 2003-142180 | | 5/2003 |

* cited by examiner

ELECTRICAL CONNECTOR WITH FLEXIBLE CIRCUIT BOARD

TECHNICAL FIELD

This invention relates to a connector.

BACKGROUND ART

A conventional connector of this kind will be described with reference to FIG. 9 to FIG. 11. In the drawings, 1 denotes a connector, and a number of contact pins 3 are fixed in parallel rows to left and right opposite side portions (upper and lower portions in FIG. 1) of a mold 2 of the connector 1, and are arranged to be exposed to the exterior from the left and right opposite sides of the mold 2. And, a circuit board (not shown) such as a flexible board is provided at lower surfaces of contact pins 3, and the contact pins 3 are soldered to the circuit board to be electrically connected thereto. The circuit board is connected to other electronic parts.

Then, a plug (not shown) is fitted to the connector, and contact pins of the plug are connected to the contact pins 3 of the connector 1, and by doing so electronic parts connected to the plug are electrically connected to the electronic parts connected to the connector 1 via the flexible board.

Also, there is known an electric connector which is a connector in which a plug connector and a receptacle connector are fitted together and which is constructed such that a resilient force is imparted to contact pins of the receptacle connector so that good contact of the contact pins with contact pins of the plug connector can be maintained (For example, see Japanese Patent Publication No. 11-26102A)

Further, there is known a cover-equipped connector having a construction in which a cover is provided at a plug insertion port of the connector, and the intrusion of foreign matters between contact pins of a plug and contact pins of the connector is prevented by the cover so as to prevent electrical short-circuiting and breakage of the connector (For example, see Japanese Patent Publication No. 10-340753A).

The above-mentioned conventional connector is constructed such that the plug or the like is connected to the connector so as to electrically connect the electronic parts electrically connected to the plug to the electronic parts connected to the connector. The contact pins of the connector are fixed to the mold, and also are connected to terminals of the circuit board by soldering or the like.

However, the contact pins of the connector are soldered in such a manner that the contact pins are exposed to the exterior, and therefore may be damaged by an external impact, and besides the contact pins may be subjected to short-circuiting by the intrusion of foreign matters, and therefore this has been the cause of a degraded quality.

DISCLOSURE OF THE INVENTION

It is therefore an object of this invention to provide a connector in which damage of contact pins by an external impact as well as the intrusion of foreign matters into a contact pin-mounted portion is prevented so that the quality can be enhanced.

In order to achieve the above object, according to the invention, there is provided a connector, including:

a housing body;

a contact pin, accommodated in the housing body such that a first end portion of which is adapted to be subjected to soldering and projected from an outer face of the housing body; and a cover body, coupled to the housing body so as to cover the first end portion of the contact pin.

With this construction, the first end portion of the contact pin which is adapted to be subjected to soldering is covered with the cover body, and therefore an external impact against the contact pin is prevented by the cover body, and also the intrusion of foreign matters is prevented.

The cover body may include a first cover supporting the first end portion of the contact pin and a second cover covering the first end portion of the contact pin.

With this construction, the cover body can be easily mounted on the housing body.

The housing body may have a groove opened at a bottom face and a first side face thereof, and the first cover may be inserted into the groove from the first side face.

With this construction, the first cover can be easily mounted on the housing body by inserting it into the groove from the first side face of the housing body.

The connector may include a flexible circuit board having a terminal adapted to be electrically connected to the first end portion of the contact pin by the soldering, and inserted between the housing body and the first cover from a second side face opposite to the first side face.

With this construction, the first cover is inserted into the mold from the direction opposite to the flexible circuit board connected to the connector, and therefore the flexible board will not prevent the mounting of the first cover, and the first cover can be easily attached.

The second cover may be a frame-shaped member adapted to surround an outer periphery of the housing body.

With this construction, the second cover is formed into the square frame-shape, and therefore the second cover covers the first end portion of the contact pin exposed to the exterior of the housing body, and also a plug insertion portion or a board insertion portion of the connector is exposed from a central portion of the second cover.

BEST MODE FOR CARRYING OUT THE INVENTION

Figure 1:
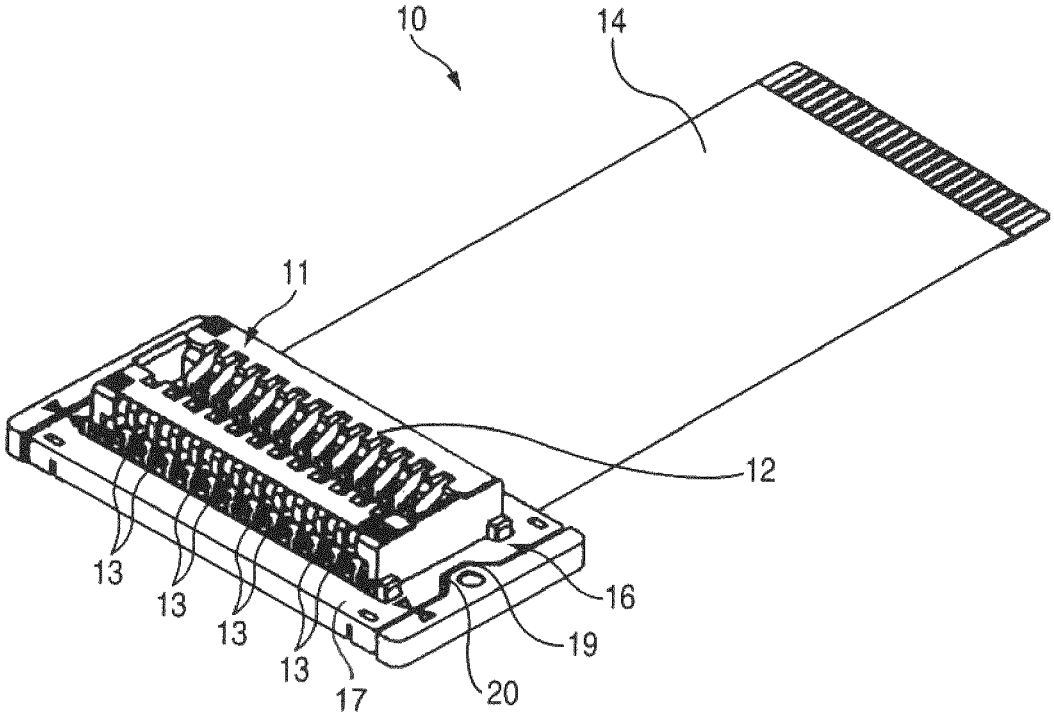
FIG. 1 is a perspective view of one embodiment of a connector of the present invention.

One embodiment of the present invention will now be described in detail with reference to FIG. 1 to FIG. 8. FIG. 1 shows one embodiment of a connector 10 the present invention, and is used in a car audio equipment or the like. In the connector 10, a central portion of a mold 11 is projected, and further a groove is formed in a central portion of this projected portion to form an insertion port 12 to which other circuit board is adapted to be attached.

Contact pins 13 are fixed to the mold 11 in left-right opposed relation, and further a flexible board 14 is inserted into the mold 11. Then, as shown in FIG. 2 and FIG. 3, distal end portions of the contact pins 13 are fixed by soldering to terminals 15 of the flexible board 14, respectively.

Figure 4:
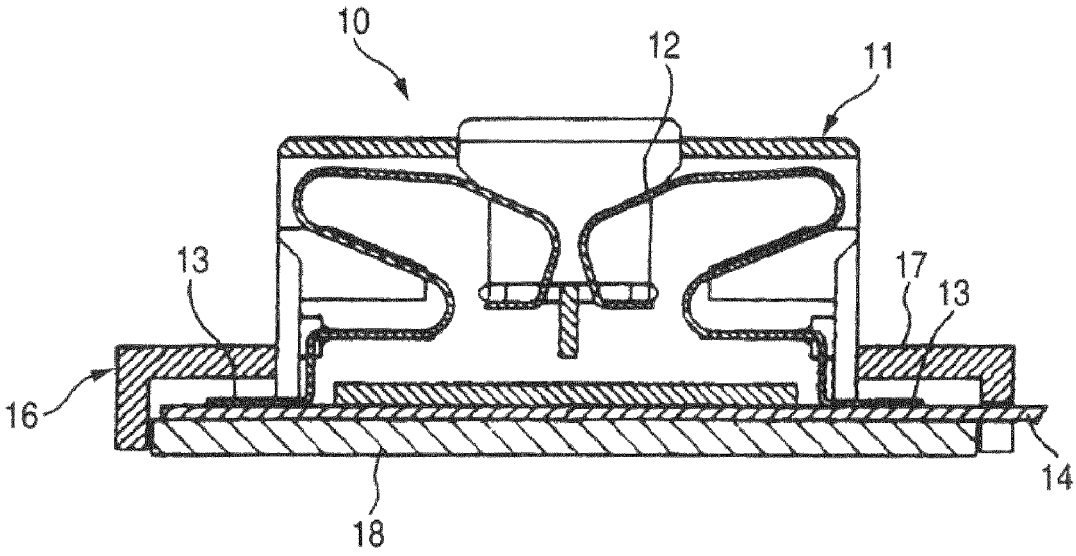
FIG. 4 is a cross-sectional view taken along the line IV-IV of FIG. 2.

As shown in FIG. 4, the contact pins 13 are curved inwardly at a central portion of the insertion port 12, and extend laterally upwardly, and then are curved inwardly, and are bent laterally at their lower portions, so that the distal end portions of the contact pins 13 are exposed to the exterior of the mold 11.

On the one hand, the upper side of the externally-exposed portions of the contact pins 13 disposed at an edge portion around the outer periphery of the insertion port 12 and a lower surface of the connector 10 are covered with a cover 16. The cover 16 is composed of an upper cover 17 and a lower cover 18.

Figure 2:
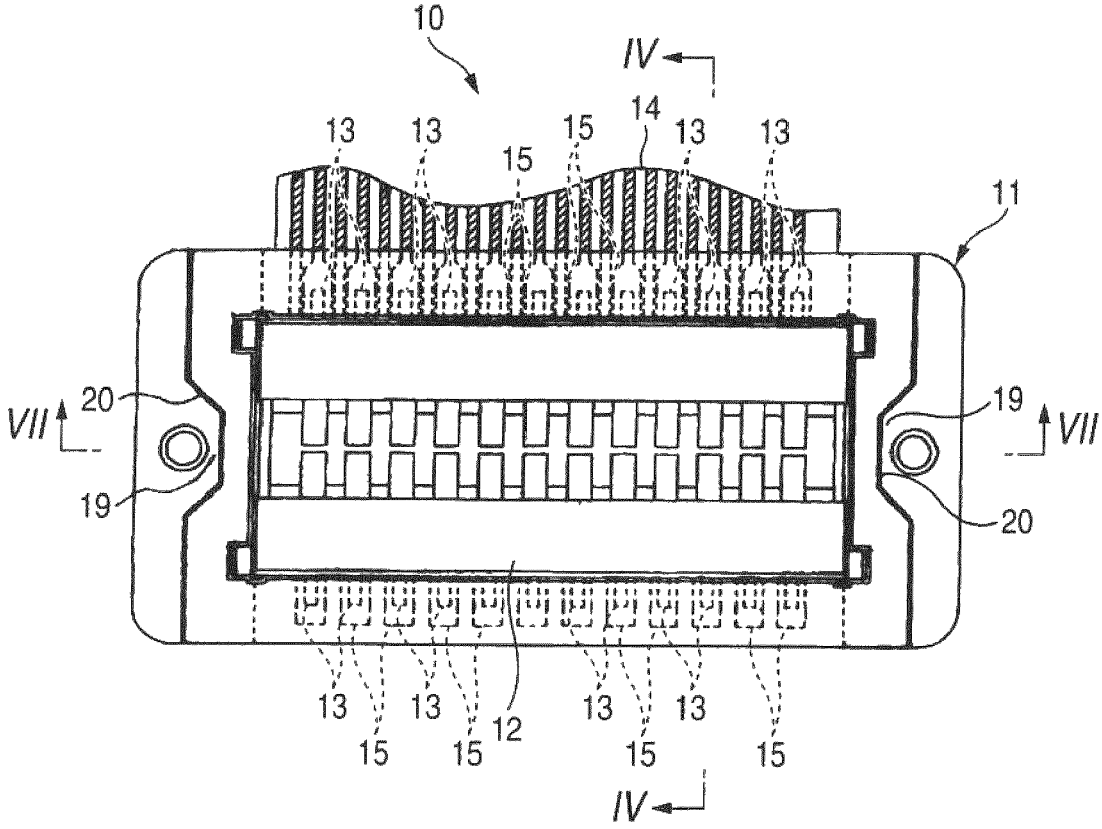
FIG. 2 is a plan view of the connector.
Figure 3:
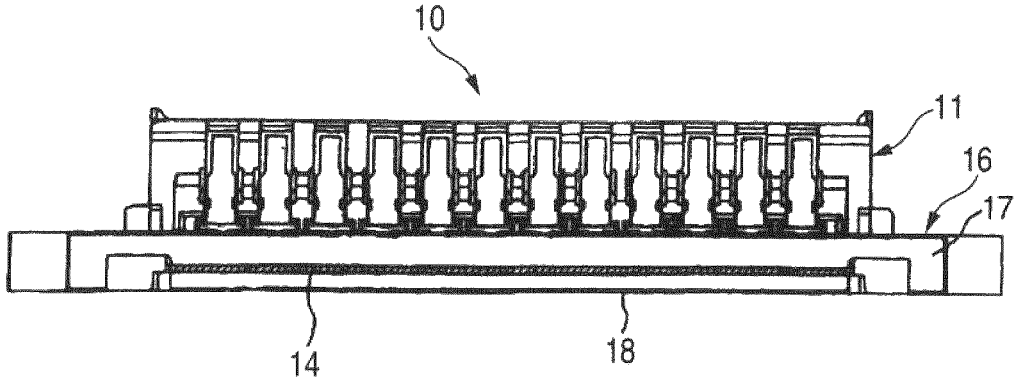
FIG. 3 is a side-elevational view of the connector.
Figure 5:
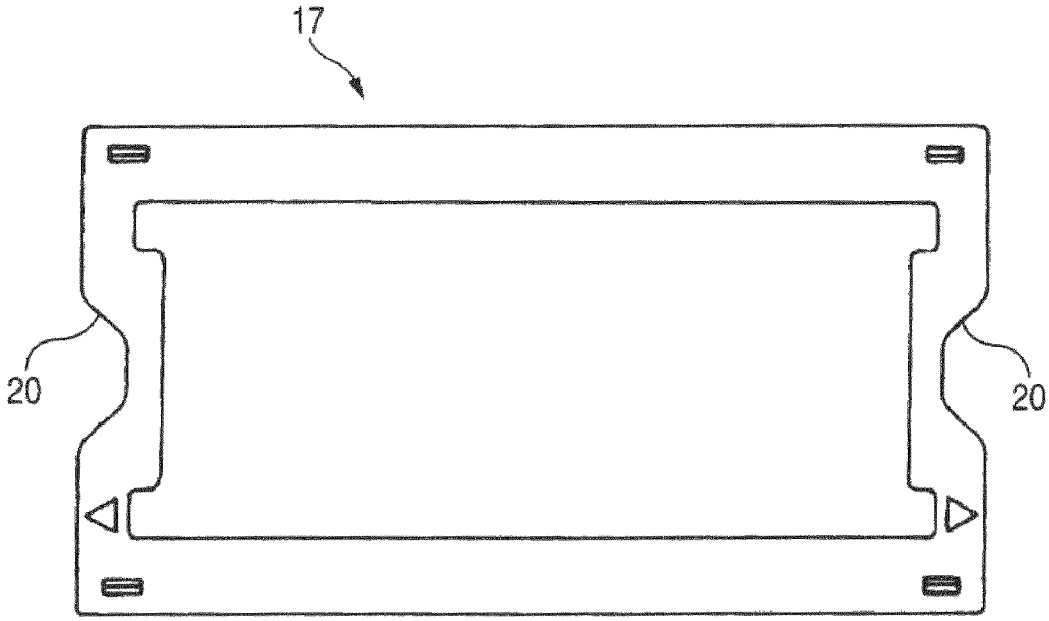
FIG. 5 is a plan view of an upper cover of the connector.

As shown in FIG. 2 and FIG. 5, the upper cover 17 is formed into a square frame-shape. Further, the upper cover 17 is formed into a cross-sectionally L-shape, and is so constructed as to cover the upper side of the contact pins 13 exposed from the mold 11. Convex portions 19 formed respectively at opposite side portions (left and right in FIG. 2) of the mold 11 can be fitted respectively in recesses 20 formed respectively in opposite side portions of the upper cover 17, thereby fixing the upper cover 17 to the mold 11.

Figure 6:
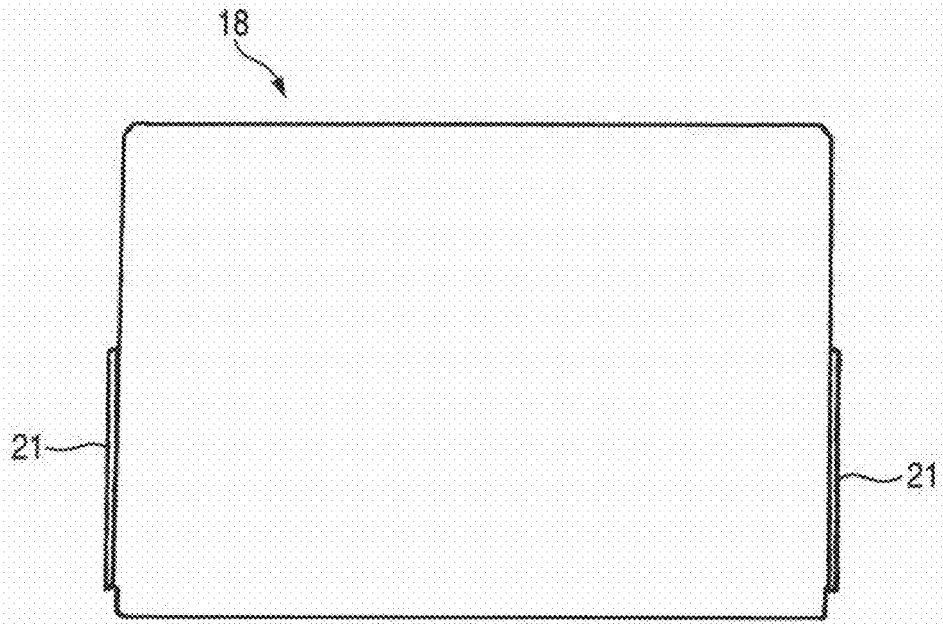
FIG. 6 is a plan view of a lower cover of the connector.
Figure 7:
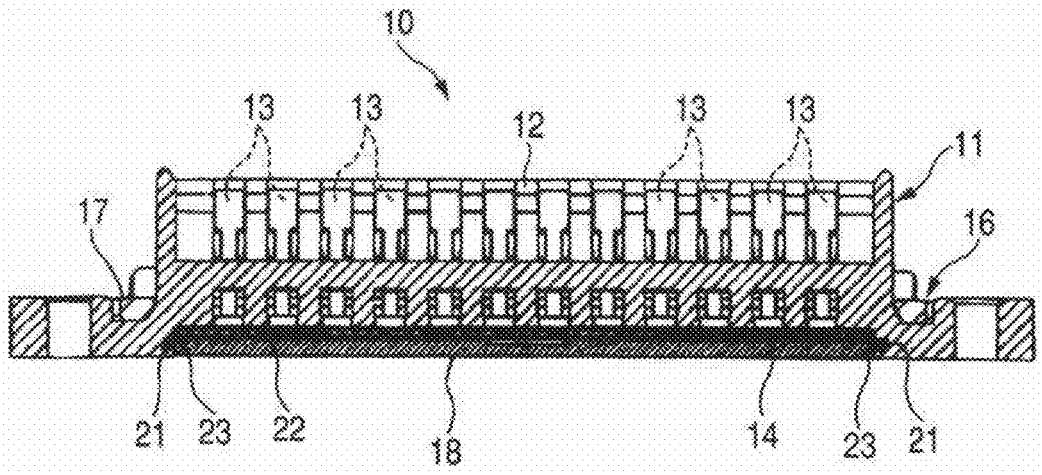
FIG. 7 is a cross-sectional view taken along the line VII-VII of FIG. 2.

On the one hand, with respect to the lower cover 18, as shown in FIG. 6 and FIG. 7, side edge portions of the lower cover 18 are stepped to provide sliding portions 21 in a projecting manner. A recessed portion 22 in which the lower cover 18 can be mounted is formed in the reverse surface of the mold 11, and grooves 23 are formed in side surfaces of the recessed portion 22 so as to guide the sliding portions 21 of the lower cover 18. Therefore, the lower cover 18 is slidably attached to the mold 11.

Figure 8:
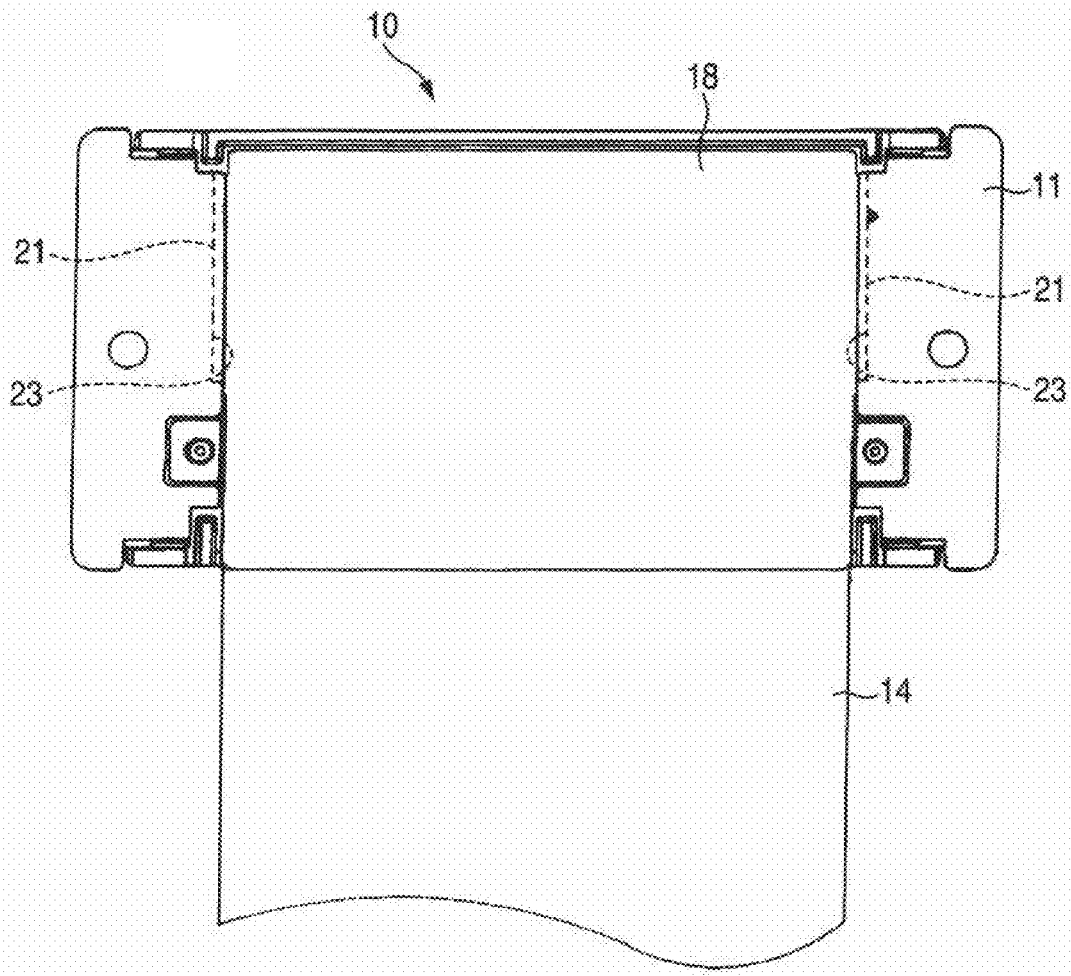
FIG. 8 is a bottom view of the connector.
Figure 9:
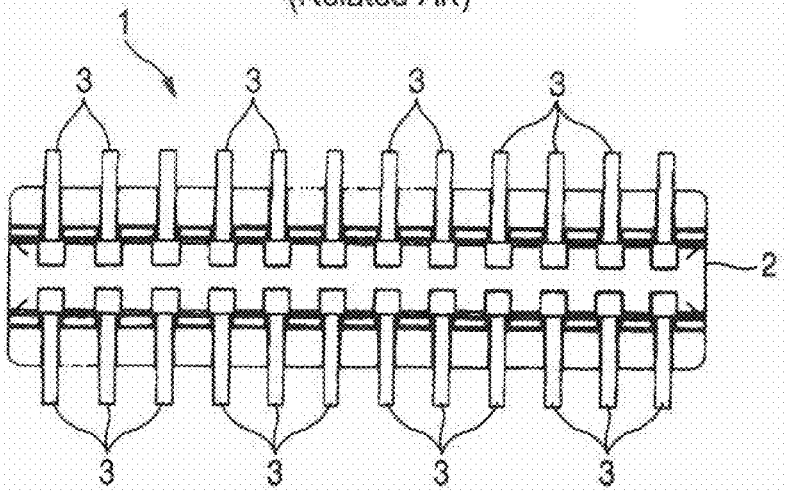
FIG. 9 (Related Art)
FIG. 9 is a plan view of a conventional connector.
Figure 10:
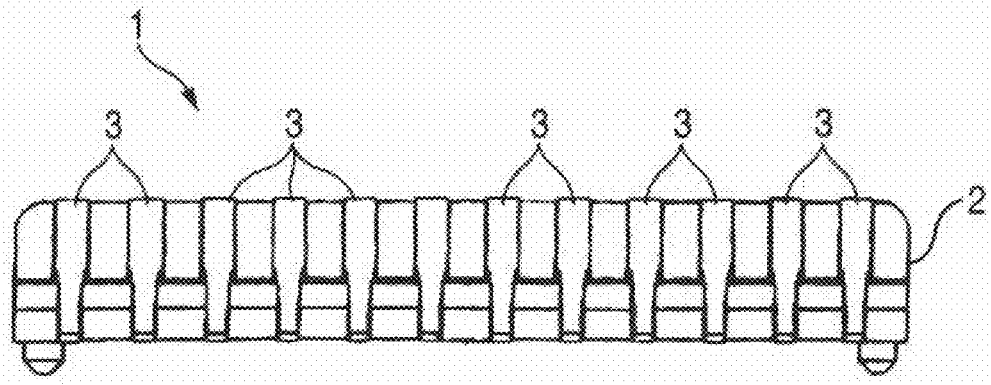
FIG. 10 (Related Art)
FIG. 10 is a side-elevational view of the conventional connector.
Figure 11:
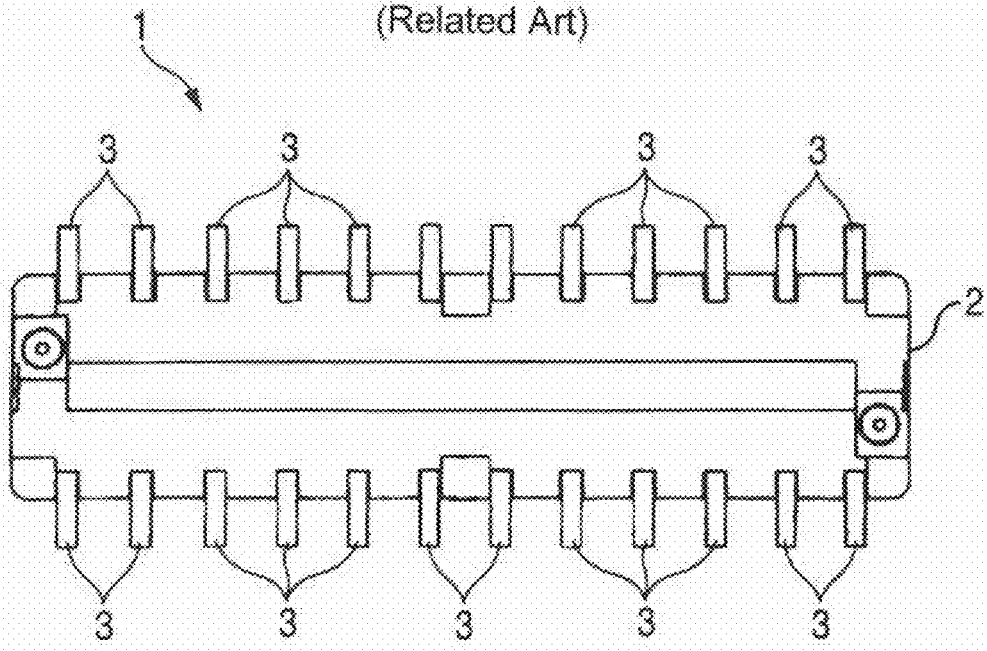
FIG. 11 (Related Art)
FIG. 11 is a bottom view of the conventional connector.

As shown in FIG. 8, the grooves 23 in the mold 11 are formed to extend from a rear portion to a middle portion of the mold 11 in the forward-rearward direction, and by inserting the sliding portions 21 of the lower cover 18 respectively into the grooves 23 from the rear side of the connector 10, the lower cover 18 is attached to the mold 11. Then, a distal end portion of the lower cover 18 abuts against rear end portions of the grooves 23, so that the forward movement of the lower cover 18 is limited.

Further, as shown in FIG. 7 and FIG. 8, the flexible board 14 is inserted to be disposed at the lower surface of the mold 11 and also on the upper surface of the lower cover 18. The flexible board 14 is inserted from the front side (the right side in FIG. 1), and the contact pins 13 are soldered respectively to the terminals 15 of the flexible board 14, and the flexible board 14 extends forwardly from the connector 10.

When assembling the connector 10, the flexible board 14 is inserted from the front side to be disposed at the lower surface of the mold 11 having the contact pins 13 mounted thereon, and the terminals 15 of the flexible board 14 are fixed by soldering to the distal end portions of the contact pins 13, respectively.

Then, the lower cover 18 is pushed in from the outer side face of the recessed portion 22 of the mold 11. At this time, the sliding portions 21 slide respectively along the grooves 23 of the recessed portion 22, and the sliding portions 21 abut against the rear end portions of the grooves 23, respectively, so that the forward movement of the lower cover 18 is limited, and the lower cover 18 is attached to the mold 11. When attaching the lower cover 18, the flexible board 14 will not prevent the attaching of the lower cover 18 since the flexible board 14 extends forwardly, and the lower cover 18 can be easily mounted on the mold 11.

By attaching the upper cover 17 to the peripheral edge portion of the mold 11 from the upper side of the mold 11, the upper cover 17 is fixed to the mold 11. At this time, the lower end of the end edge of the upper cover 17 abuts against the peripheral edge portion of the lower cover 18 as shown in FIG. 4, thereby preventing the movement of the lower cover 18, and therefore the lower cover 18 is stably fixed to the mold 11.

In the thus constructed connector 10, the connected portions between the contact pins 13 and the terminals 15 of the flexible board 14 are covered with the cover 16, and therefore fears for damage of the connection between the contact pins 13 and the terminals 15 due to an external impact, etc., can be eliminated. Furthermore, the intrusion of foreign matters can be prevented by the cover 16, and the electrical short-circuiting of the contact pins 13 is prevented, thereby enhancing the quality of the connector 10.

And, by inserting other flexible board (not shown) of various kinds into the insertion port 12, electronic parts connected to the flexible board are electrically connected to the electronic parts connected to the connector 10 via the flexible board.

Incidentally, various modifications can be made without departing from the spirits of the prevent invention, and naturally, the present invention covers such modifications.

The invention claimed is:

1. A connector, comprising:

a housing body;

a contact pin, accommodated in the housing body and having a first end portion projected from an outer face of the housing body and adapted to be soldered to a circuit board; and a cover body, coupled to the housing body so as to cover the first end portion of the contact pin, wherein the cover body includes a first cover supporting the first end portion of the contact pin and a second cover covering the first end portion of the contact pin, wherein the housing body has a groove opened at a bottom face and a first side face thereof; and the first cover is inserted into the groove from the first side face.

2. The connector as set forth in claim 1, wherein:

the circuit board is flexible, and the circuit board has a terminal adapted to be electrically connected to the first end portion of the contact pin by the soldering, and is inserted between the housing body and the first cover from a second side face opposite to the first side face.

3. The connector as set forth in claim 1, wherein:

the second cover is a frame-shaped member adapted to surround an outer periphery of the housing body.

* * * * *